United States Patent [19]

King

[11] Patent Number: 4,917,249

[45] Date of Patent: Apr. 17, 1990

[54] COLLAPSIBLE CLOTHING RACK

[76] Inventor: Shaylor E. King, 52687 Stephen Pl., Elkhart, Ind. 46514

[21] Appl. No.: 340,045

[22] Filed: Apr. 18, 1989

[51] Int. Cl.[4] ..... A47F 7/00

[52] U.S. Cl. ..... 211/86; 211/204; 248/231.4

[58] Field of Search ..... 211/86, 204; 248/231.4, 248/217.1, 217.2, 231.6, 231.7; 108/28, 29

[56] References Cited

U.S. PATENT DOCUMENTS

| | | | |
|---|---|---|---|
| 1,349,225 | 8/1920 | Rosenblum | 248/231.4 X |
| 2,823,884 | 2/1958 | Lagerstrom | 211/86 |
| 2,854,148 | 9/1958 | Mattos et al. | 108/28 |
| 2,905,423 | 9/1959 | Smith et al. | 248/231.7 |
| 2,916,158 | 12/1959 | Vosbikian et al. | 211/86 |
| 3,363,777 | 1/1968 | Cooper | 211/86 |
| 3,435,957 | 4/1969 | Lloyd | 211/86 |
| 3,451,558 | 6/1969 | Cohen | 211/86 |

*Primary Examiner*—Robert W. Gibson, Jr.
*Attorney, Agent, or Firm*—James D. Hall; Thomas J. Dodd; Todd A. Dawson

[57] ABSTRACT

A clothing rack which is connected to a support structure such as an ironing board. The clothing rack includes a generally U-shaped base connected to an L-shaped support. A disk is connected to the vertical portion of the L-shaped support and functions with the base to clamp the clothing rack to the ironing board. A tubular extension is connected to the vertical support at the top by a bracket. The connecting bracket permits the tubular extension to be shifted between operative and storage positions.

3 Claims, 2 Drawing Sheets

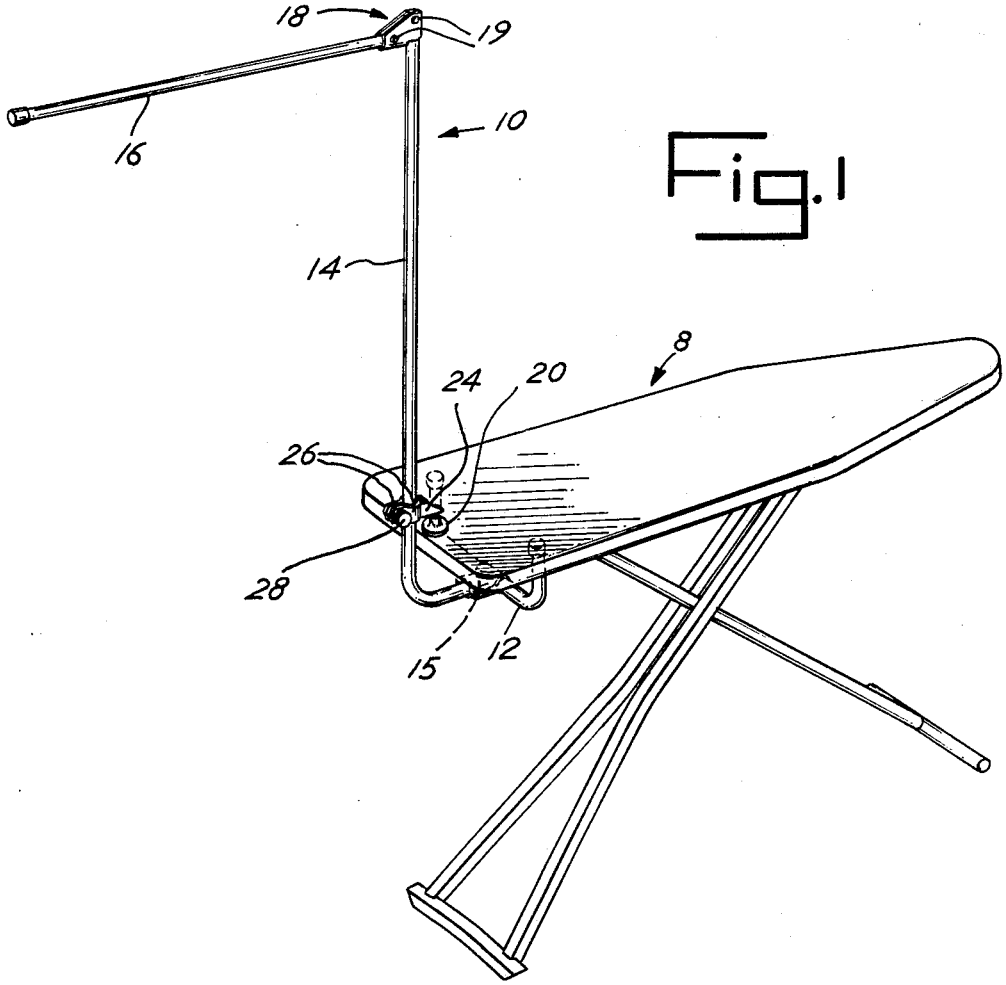
Fig. 1
Fig. 2
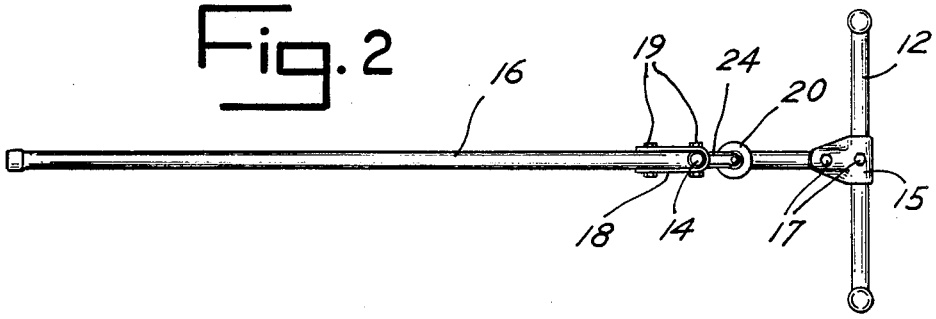

Fig. 3
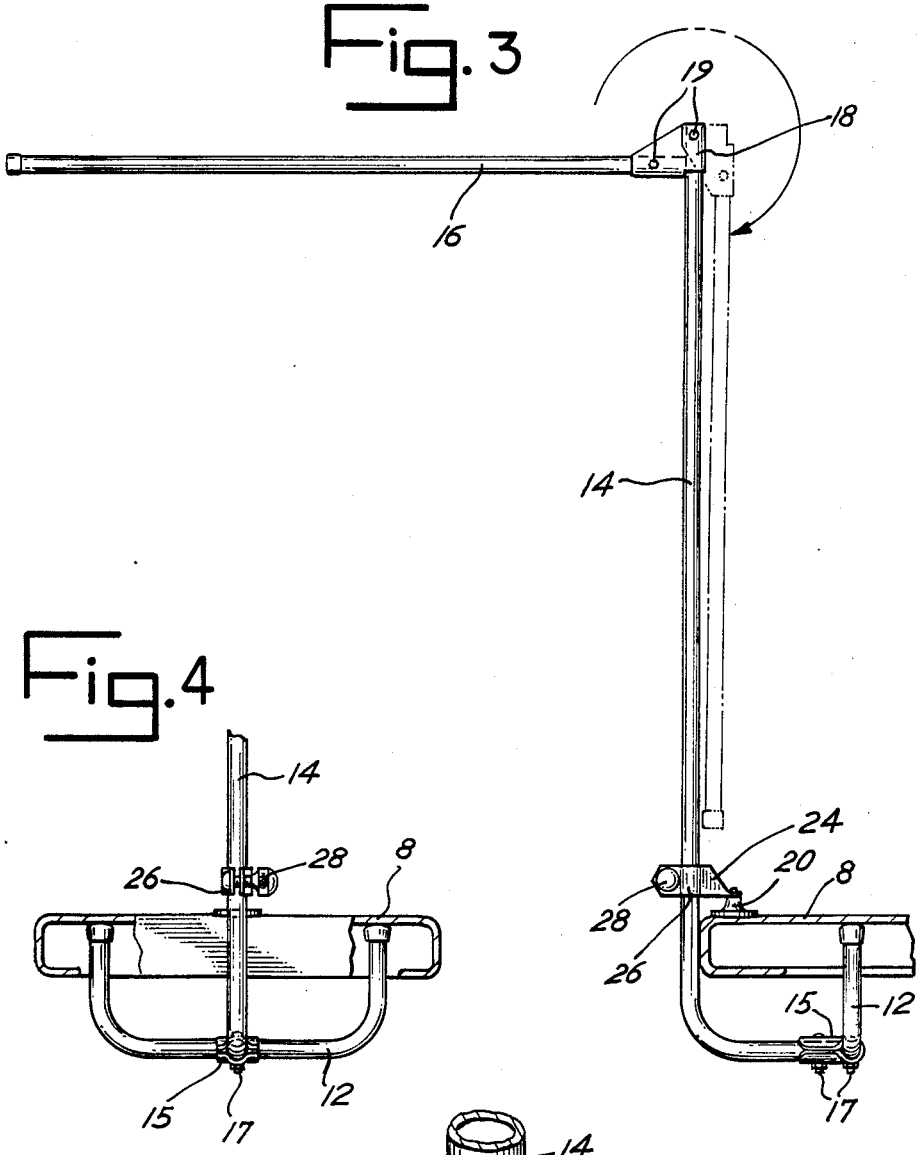
Fig. 4
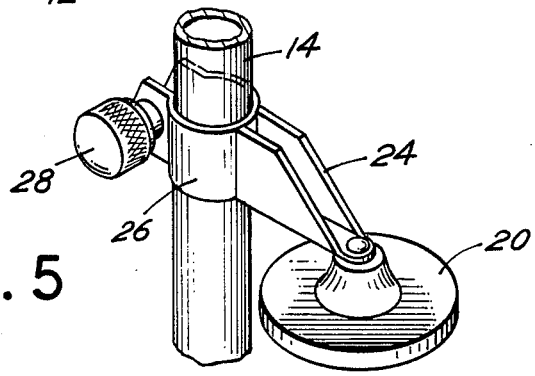
Fig. 5

COLLAPSIBLE CLOTHING RACK

SUMMARY OF THE INVENTION

This invention relates to a collapsible clothing rack and will have application to a clothing rack which may be detachably connected to a support structure.

The collapsible clothing rack of this invention features a horizontal clothes support bar which is detachably connected to an L-shaped support rod. The L-shaped support rod is connected to a generally U-shaped base support which abuts the underside of the ironing board. The clothing rack is secured to the surface of the ironing board by a disk which is connected to a bracket fitted about the L-shaped support rod. The disk can be raised or lowered along the L-shaped support rod to accommodate varying thicknesses of ironing boards or similar supports.

Accordingly, it is an object of this invention to provide for a novel collapsible clothing rack.

Another object of this invention is to provide for a clothing rack which is readily removable from its support structure and is collapsible for convenient storage when not in use.

Another object is to provide for a clothing rack which is economical to manufacture.

Other objects of this invention will become apparent upon a reading of the following description taken with the accompanying drawings.

BRIEF DESCRIPTION OF THE DRAWINGS

FIG. 1 is a perspective view of the clothing rack of this invention shown connected to an ironing board.

FIG. 2 is a top plan view of the clothing rack of this invention in an operative position.

FIG. 3 is an elevation view of the clothing rack after connection to the ironing board, with the rack shown in an operative position in solid lines, and in its collapsed position in broken lines.

FIG. 4 is a fragmented end view of the lower section of the clothing rack with portions cut away for illustrative purposes.

FIG. 5 a fragmented perspective view of the upper support clamp.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

With reference to the drawings, reference numeral 10 generally refers to the clothing rack of this invention which is used as a support from which to hang garments suspended from clothing hangers (not shown). Clothing rack 10 is adapted for connection to a support such as ironing board 8.

Clothing rack 10 generally consists of a tubular support frame which includes U-shaped base support 12, L-shaped tubular support rod 14 and horizontal support rod 16. L-shaped support rod 14 through a T-type bracket 15. Fasteners 17 may be utilized to connect base support 12 and rod 14 to bracket 15. Horizontal support rod 16 is connected to L-shaped support rod 14 by a bracket 18 which has perpendicularly oriented bores to accommodate the rods in the orientation shown. Fasteners 19 may be utilized to connect rods 14, 16 to bracket 18.

Clothing rack 10 is connected to ironing board 8 by disk 20 which in turn is connected to bracket 24. Bracket 24 includes spaced ears 26 slidably fitted about rod 14 and is secured thereto by a knurled knob 28 which can be loosened or tightened to permit or inhibit sliding movement of disk 20 along support rod 14. By moving disk 20 downward into contact with ironing board 8, clothing rack 1O may be secured to the ironing board.

FIG. 3 illustrates in broken lines the reorientation of bracket 18 through which rod 16 can be folded over and collapsed into a storage position.

It is understood that the invention is not limited to the above details, but may be modified within the scope of the following claims.

I claim:

1. In combination, a rack adapted to support clothing, and a support structure having a substantially flat support surface, said rack comprising a support frame including a base, a generally L-shaped rod connected to said base and extending upwardly above said support structure, a clothes support rod detachably connected to said L-shaped rod above said support structure flat surface, and support means adjustably connected to said L-shaped rod for contacting said flat surface at a top face thereof, said base abutting said flat surface at a bottom face thereof, said base and support means constituting means for detachably securing said rack to said support structure.

2. The combination of claim 1 wherein said support structure is an ironing board.

3. The combination of claim 1 wherein said support means includes a disk, a bracket slidably connected to said shaft, said bracket carrying said disk.

* * * * *